US008188872B2

(12) United States Patent
Fischer

(10) Patent No.: US 8,188,872 B2
(45) Date of Patent: May 29, 2012

(54) ROBUST EVALUATION OF A TEMPERATURE MEASUREMENT SIGNAL BY USING A DYNAMIC ADAPTATION OF A COMPUTATIONAL MODEL

(75) Inventor: Martin Fischer, Bülach (CH)

(73) Assignee: Siemens Aktiengesellschaft, Munich (DE)

( * ) Notice: Subject to any disclaimer, the term of this patent is extended or adjusted under 35 U.S.C. 154(b) by 426 days.

(21) Appl. No.: 12/372,199

(22) Filed: Feb. 17, 2009

(65) Prior Publication Data

US 2009/0207030 A1 Aug. 20, 2009

(30) Foreign Application Priority Data

Feb. 15, 2008 (EP) ..... 08101644

(51) Int. Cl.
*G08B 17/00* (2006.01)

(52) U.S. Cl. ..... 340/588; 340/584; 340/589

(58) Field of Classification Search ..... 340/577, 340/584, 587, 588, 589, 501, 511; 219/494, 219/486, 483, 485; 700/117, 210; 62/180, 62/186; 702/132
See application file for complete search history.

(56) References Cited

U.S. PATENT DOCUMENTS 4,223,385 A * 9/1980 Miller et al. ..... 700/210
4,399,428 A 8/1983 Hughes et al.
4,922,230 A 5/1990 Ohtani et al.
5,448,224 A 9/1995 Mochizuki
5,583,780 A * 12/1996 Kee et al. ..... 700/117
5,654,904 A * 8/1997 Thakur ..... 702/137
5,700,993 A * 12/1997 Counsell et al. ..... 219/483
5,712,802 A * 1/1998 Kumar et al. ..... 702/132
6,373,033 B1 * 4/2002 de Waard et al. ..... 219/497
6,896,404 B2 * 5/2005 Seki et al. ..... 374/29
6,951,998 B2 * 10/2005 Nanno et al. ..... 219/494
2010/0059598 A1 * 3/2010 Lindgren et al. ..... 236/91 E

FOREIGN PATENT DOCUMENTS

EP 0 622 767 A1 11/1994
GB 2 209 086 A 4/1989

* cited by examiner

*Primary Examiner* — Van T. Trieu
(74) *Attorney, Agent, or Firm* — Laurence A. Greenberg; Werner H. Stemer; Ralph E. Locher

(57) ABSTRACT

A device for evaluating a temperature measurement signal of a temperature measurement facility has a modeling unit with a first input for picking up an input signal which is indicative for the temperature measurement signal, a second input for picking up a feedback signal, and an output for outputting an output signal. The output signal can be generated in dependence on the input signal and the feedback signal by using a computational model stored in the modeling unit. The feedback signal (slope) is directly or indirectly dependent on the output signal. Furthermore, an alarm indicator with an evaluation device of this type and a method for evaluating a temperature measurement signal are provided. Alongside this, a computer-readable storage medium and also a program element are described, which contain instructions for carrying out the evaluation method.

13 Claims, 2 Drawing Sheets

ROBUST EVALUATION OF A TEMPERATURE MEASUREMENT SIGNAL BY USING A DYNAMIC ADAPTATION OF A COMPUTATIONAL MODEL

CROSS-REFERENCE TO RELATED APPLICATION

This application claims the priority, under 35 U.S.C. §119, of German application EP 08 101 644, filed Feb. 15, 2008; the prior application is herewith incorporated by reference in its entirety.

BACKGROUND OF THE INVENTION

Field of the Invention

The present invention relates to the technical field of evaluation of measurement signals of a temperature measurement facility for the purpose of at least partly eliminating a thermal inertia, which is caused by one or more heat storage capacities particularly in the presence of marked temperature changes. The present invention relates particularly to a device and a method for evaluating a temperature measurement signal of a temperature measurement facility with the use of a computational model. The present invention furthermore relates to an alarm indicator for outputting an alarm indication in dependence on a temperature captured within a monitoring range, the alarm indicator having a device of the aforesaid type. Alongside this, the present invention relates to a computer-readable storage medium and also a program element, which contain instructions for carrying out the inventive method for evaluating a temperature measurement signal of a temperature measurement facility.

Known thermal alarm indicators have at least one temperature sensor for capturing a temperature present within a monitoring range. To ensure a rapid response behavior and therefore meet the technical standards EN54-5, UL521, and FM3210 that are relevant for commercial marketing, the temperature sensor should be as free from ambient thermal masses as possible.

However, limits apply in practice to any thermal decoupling between the temperature sensor and adjacent thermal masses.

Thus, a spatial separation between the temperature sensor and adjacent thermal masses would require a relatively large cavity within a thermal alarm indicator for example. To ensure a good thermal coupling of the temperature sensor to the monitoring range, this cavity should be capable of being effectively traversed by the ambient air. Furthermore, the temperature sensor should be arranged in the center of the cavity. Particularly in the case of combination indicators, which apart from a thermal sensor input also have a further, for example an optical, sensor input, such a large cavity is not available as a rule due to space problems. Alongside this, the effective space requirement of such an alarm indicator would be very large. This would also be unsatisfactory on aesthetic grounds.

Alongside this, there are also, due to legal requirements, specific restrictions relating to the arrangement of a temperature sensor. For example, it must be protected from mechanical influences, which results in the situation that the temperature sensor cannot be mounted completely freely and therefore constantly has an unavoidable and not inconsiderable thermal coupling to other components of the alarm indicator.

To improve the response behavior of a thermal alarm indicator, it is furthermore a known approach to condition the initial temperature measurement signal of a temperature sensor with a view to a more rapid signal rise in the presence of major changes in temperature. As is already known, this can be affected in an evaluation logic component of a thermal alarm indicator. To this end, the evaluation logic component frequently contains a thermal model of the temperature sensor and/or the housing of the alarm indicator. By a suitable procedure, which encompasses an inversion of the thermal model, the signal evaluation can be improved with a view to a more rapid response behavior. In this respect, a so-called virtual temperature is calculated, which then represents the alarm criterion for the thermal alarm indicator.

However, such a rigid implementation of the inversion of a thermal model for the signal evaluation has the now described drawbacks among other things.

First, in terms of the principle, any modeling of the response of the temperature sensor and/or the housing is a low-pass. The model inversion consequently produces a high-pass in terms of behavior. Therefore, e.g. in the case of step responses, the model inversion tends to produce overshoots. This represents a common problem in control engineering. However, if an overshoot becomes too large, an undesirable false alarm can be triggered by accident. Corresponding alarm indicators therefore frequently cannot meet, chiefly, the statutory standard EN54-5 applying in Europe and the standard GB4716 applying in China, which specify among other things that in the presence of a sudden temperature change from 5 degrees Celsius to 50 degrees Celsius, no alarm must be triggered. This is also referred to as the so-called Step Response Test.

Second, the American statutory standard FM3210 for thermal alarm indicators assigns a so-called rate of time index (RTI) value to every indicator. This value is essentially ascertained by way of the so-called "plunge tunnel test". This measures how rapidly a thermal alarm indicator outputs an alarm signal when it is suddenly introduced into an oven heated to 197° Celsius. If then, for example due to the first limitation described above, an artificial delaying of the response sensitivity is introduced for the purpose of reducing overshoots, for example in the form of a limitation on the rate of change ("slope limitation"), then the thermal alarm indicator will produce an alarm too late and not be given a valid RTI value. Therefore, the legal marketing of such an alarm indicator is not possible in the USA.

SUMMARY OF THE INVENTION

It is accordingly an object of the invention to provide a robust evaluation of a temperature measurement signal by using a dynamic adaptation of a computational model which overcome the above-mentioned disadvantages of the prior art methods and devices of this general type, which improves the evaluation of the temperature measurement signal by using the computational model with a view to the prevention or at least reduction of false alarm indications and a short triggering time for genuine alarm indications.

According to a first aspect of the invention, a device for evaluating a temperature measurement signal of a temperature measurement facility is described, which device is particularly suitable for evaluating a temperature measurement signal that is variable over time of a temperature measurement facility of an alarm indicator. The device described has a modeling unit with a first input for picking up an input signal, which is indicative for the temperature measurement signal, a second input for picking up a feedback signal, and an output for outputting an output signal. According to the invention, the output signal can be generated in dependence on the input signal and the feedback signal by using a computational model stored in the modeling unit. Furthermore, the feedback signal is directly or indirectly dependent on the output signal.

The evaluation device described is based on the finding that, in the course of the evaluation of a temperature profile captured initially by the temperature measurement facility, undesirable artifacts can be prevented in the determination of a real temperature profile by a dynamic adaptation of the computational model. Such artifacts can be undesirable overshoots, for example, which can occur particularly in the presence of relatively sudden temperature changes in the case of a temperature evaluation using a conventional evaluation device without the use of a feedback signal. The described dynamic adaptation of the computational model therefore permits a robust tracking of the real ambient temperature present.

In the case of the dynamic adaptation of the computational model, therefore, the model settings of the computational model are varied on the basis of measured variables captured dynamically during the course of the temperature measurement or the course of the temperature evaluation. This stabilizes the calculated temperature signal so that the robustness of the alarm indicator is improved particularly in the presence of real, difficult environmental conditions such as for example strongly fluctuating temperatures and/or strong incident flow speeds.

The input signal used by the evaluation unit is indicative for the temperature measurement signal. This can mean that the temperature measurement signal and the input signal are identical. The input signal can likewise also be produced from the temperature measurement signal by amplification, which is preferably linear.

According to an exemplary embodiment of the invention, the computational model has at least one model parameter, the value of which is determined by the feedback signal.

In this respect, the at least one model parameter can reflect physical effects such as for example the level of the thermal coupling between the temperature measurement facility and the medium for which the temperature is being measured. The model parameter can also take account of the heat storage capacity or the thermal inertia of the temperature measurement facility and/or other components of an alarm indicator, which components are thermally coupled to the temperature measurement facility. Preferably, a dedicated model parameter is used for each separate influence, caused by physical effects, on the temperature measurement. In this respect, there is no upper limit in principle in terms of the quantity of usable model parameters.

According to a further exemplary embodiment of the invention, the computational model represents the inversion of a thermal model of the temperature measurement facility.

In this respect, the thermal model takes account of the heat storage capacity of the temperature measurement facility, where the heat storage capacity can also be the thermal mass of a housing coupled thermally to the temperature measurement facility. The heat storage capacity naturally results in a marked attenuation of the temperature measurement signal compared with the actual temperature change within a monitoring range of the thermal alarm indicator. In this respect, the heat storage capacity of other components such as for example mountings for the temperature measurement facility, the soldered joints of the temperature measurement facility, and/or a housing of an alarm indicator can also be taken into account, with which housing the temperature measurement facility is coupled thermally.

The thermal model that describes the thermal response behavior of the temperature measurement facility in the presence of temperature changes can be described for example by an electrical low-pass of the first or higher order. In this connection, a low-pass of a higher order constitutes the connection in series of a plurality of low-passes, where the quantity of the low-passes connected in series corresponds to the order. In this case, the inversion of the thermal model represents an electrical high-pass of the first or higher order. However, as a consequence of the feedback described, overshoots can be largely prevented even in the presence of so-called step responses to a sudden temperature change. Since this means that the ambient temperature can be calculated robustly and rapidly, the alarm initiation can be kept simple without this increasing the false alarm rate. A criterion for an alarm initiation could for example involve comparing the calculated temperature with a preset threshold value.

In the case of the description of the response behavior of the temperature measurement facility by using a low-pass, at least one characteristic time constant naturally represents an important model parameter.

The inversion of the thermal model, which can be a high-pass, is dependent in its general form on various parameters (P1, P2, P3, . . . ). These are varied as a function of input variables and output variables (X1, X2, X3, . . . ). In its general form, this can be represented thus:

$$\text{ThermModelInversion}\,(P1, P2, P3, \ldots) = f(X1, X2, X3, \ldots).$$

P1, P2, P3, . . . are characteristic parameters of the thermal model inversion such as for example time constants or multiplication factors. The characteristic parameters P1, P2, P3, . . . can be produced from a linear combination of the measured variables X1, X2, X3, . . . . Alternatively, the parameters P1, P2, P3, . . . can also be produced from the measured variables X1, X2, X3, . . . by using a non-linear function.

An example of a non-linear dependency of the parameters P1, P2, P3, . . . on the measured variables X1, X2, X3, . . . is a so-called threshold value decision. A threshold value decision can for example set the parameter P1 defining a characteristic time constant equal to 2 min as soon as the measured variable X1 has a temperature increase of more than 5 K per second.

According to a further exemplary embodiment of the invention, the device additionally has a gradient calculation unit with at least one input for directly or indirectly picking up the output signal of the modeling unit and an output for providing the feedback signal. In this respect, the gradient calculation unit is set up such that the feedback signal provided is indicative for the change over time of the output signal.

This can mean that the steepness of the calculated output temperature or of the output signal is used as the input for a controlled change to the model parameters of the thermal model inversion.

The characteristic time constant(s) of the thermal model inversion is (are) therefore varied in dependence on the steepness of the output signal. In the case of steep transients, this brings about a reduction of the time constants, which therefore brings about an attenuation of the output signal as a result. The modeling unit therefore represents an adaptive filter in this case, which is varied as a function of the transients of the output signal or of the calculated output temperature.

According to a further exemplary embodiment of the invention, the device additionally has an output filter unit with an input for picking up the output signal of the modeling unit and an output for outputting an evaluation signal. In this respect, the input of the output filter unit is connected to a first input of the gradient calculation unit. Furthermore, the output of the output filter unit is connected to a second input of the gradient calculation unit.

The output filter unit can be for example a low-pass and particularly a low-pass with a low time constant. This can then operate together with the gradient calculation unit such that the gradient of the output signal of the modeling unit is ascertained virtually instantaneously.

According to a further exemplary embodiment of the invention, the device additionally has a first summation unit, which is arranged between the output of the modeling unit and the input of the output filter unit.

The summation unit can ensure that a signal that is modified compared with the immediate output signal of the modeling unit is fed to the input of the output filter unit. In this respect, a first input of the first summation unit can be connected directly to the output of the modeling unit. The input signal of the modeling unit or the temperature measurement signal can be fed directly to a second input of the first summation unit. An input signal with a negative sign is preferably provided for the signal addition by the first summation unit, so that the first summation unit can also be referred to as a subtraction unit.

According to a further exemplary embodiment of the invention, the device additionally has a second summation unit and a multiplication unit, which are arranged between the output of the first summation unit and the input of the output filter unit.

In this respect, the multiplication unit can be connected in series with the first summation unit and can multiply the output signal of the first summation unit by a specific multiplication factor. In this respect, the multiplication factor can be fed via a special input by using a suitable signal. The multiplication factor can therefore be adapted in a suitable manner at any time.

The multiplied signal can then be fed to a first input of the second summation unit. The input signal of the modeling unit or the temperature measurement signal can be fed to a second input of the second summation unit. In this case, the output signal of the second summation unit represents an addition of the multiplied signal or the output signal of the multiplication unit on the one hand and the original temperature measurement signal on the other hand.

According to a further aspect of the invention, an alarm indicator is created for outputting an alarm indication as a function of a captured temperature within a monitoring range. The alarm indicator has a temperature measurement facility for capturing the temperature within the monitoring range and a device of the type described above for evaluating a temperature measurement signal of the temperature measurement facility.

The alarm indicator is based on the finding that the evaluation device described above for evaluating the initial temperature measurement signal of the temperature measurement facility can contribute to preventing undesirable artifacts such as for example overshoots during the attempt to determine the real temperature profile in the monitoring range. According to the invention, the evaluation device is set up to dynamically adapt the computational model used in each case in the course of an evaluation. In this respect, model settings of the computational model can be varied online, i.e. instantaneously, on the basis of dynamically captured measurement variables.

The alarm indicator described can be a thermal or a so-called combination indicator, which has, apart from a thermal sensor input, a further, for example an optical, sensor input. In the case of a combination indicator, the various sensor inputs can be combined in a suitable manner during the evaluation of the respective measured variables with a view to a rapid and at the same time false-alarm-proof initiation of alarm indications.

According to a further aspect of the invention, a method is specified for evaluating a temperature measurement signal that is variable over time of a temperature measurement facility. The method is particularly suitable for evaluating a temperature measurement signal that is variable over time of a temperature measurement facility of an alarm indicator. The method includes the steps of picking up an input signal, which is indicative for the temperature measurement signal, by a first input of a modeling unit, picking up a feedback signal by a second input of the modeling unit, and outputting an output signal at an output of the modeling unit. According the invention, the output signal is generated in dependence on the input signal and the feedback signal by using a computational model stored in the modeling unit. Furthermore, the feedback signal is directly or indirectly dependent on the output signal.

The evaluation method described is also based on the finding that, by a dynamic adaptation of the computational model in the course of the evaluation of the temperature profile captured initially by the temperature measurement facility, undesirable artifacts such as for example overshoots can be prevented during the determination of a real temperature profile.

In the case of the described dynamic adaptation of the computational model, the model settings of the computational model are varied on the basis of measured variables captured dynamically during the course of the temperature measurement or of the temperature evaluation. The evaluation is therefore effected instantaneously with the temperature measurement by the temperature measurement facility irrespective of unavoidable propagation times of measurement signals and/or of a required computation or evaluation time.

Attention is drawn to the fact that the evaluation method described can be developed in an analogous manner to the evaluation device that is described above. Therefore the features that are described above of the device-related claims can also be combined with the features of the described method for evaluating a temperature measurement signal that is variable over time.

According to a further aspect of the invention, a computer-readable storage medium is described, on which a program is stored for evaluating a temperature measurement signal that is variable over time of a temperature measurement facility, particularly for evaluating a temperature measurement signal that is variable over time of a temperature measurement facility of an alarm indicator. The program, when it is executed by a processor, is set up for carrying out the aforesaid method.

According to a further aspect of the invention, a program element is described for evaluating a temperature measurement signal that is variable over time of a temperature measurement facility, particularly for evaluating a temperature measurement signal that is variable over time of a temperature measurement facility of an alarm indicator. The program element, when it is executed by a processor, is set up for carrying out the aforesaid method.

The program and/or the program element can be implemented as computer-readable instruction code in any suitable programming language such as for example JAVA, C++, etc. The program and/or the program element can be stored on a computer-readable storage medium (CD-Rom, DVD, exchangeable drive, volatile or non-volatile memory, built-in memory/processor, etc.). The instruction code can program a computer or other programmable equipment such that the desired functions are executed. Furthermore, the program and/or the program element can be provided in a network such as for example the Internet, from which it can be downloaded by a user when needed.

The invention can be realized both by using a computer program, i.e. by using a piece of software, and also by using one or more special electrical circuits, i.e. in hardware, or in any desired hybrid form, i.e. by using software components and hardware components.

Other features which are considered as characteristic for the invention are set forth in the appended claims.

Although the invention is illustrated and described herein as embodied in a robust evaluation of a temperature measurement signal by using a dynamic adaptation of a computational model, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
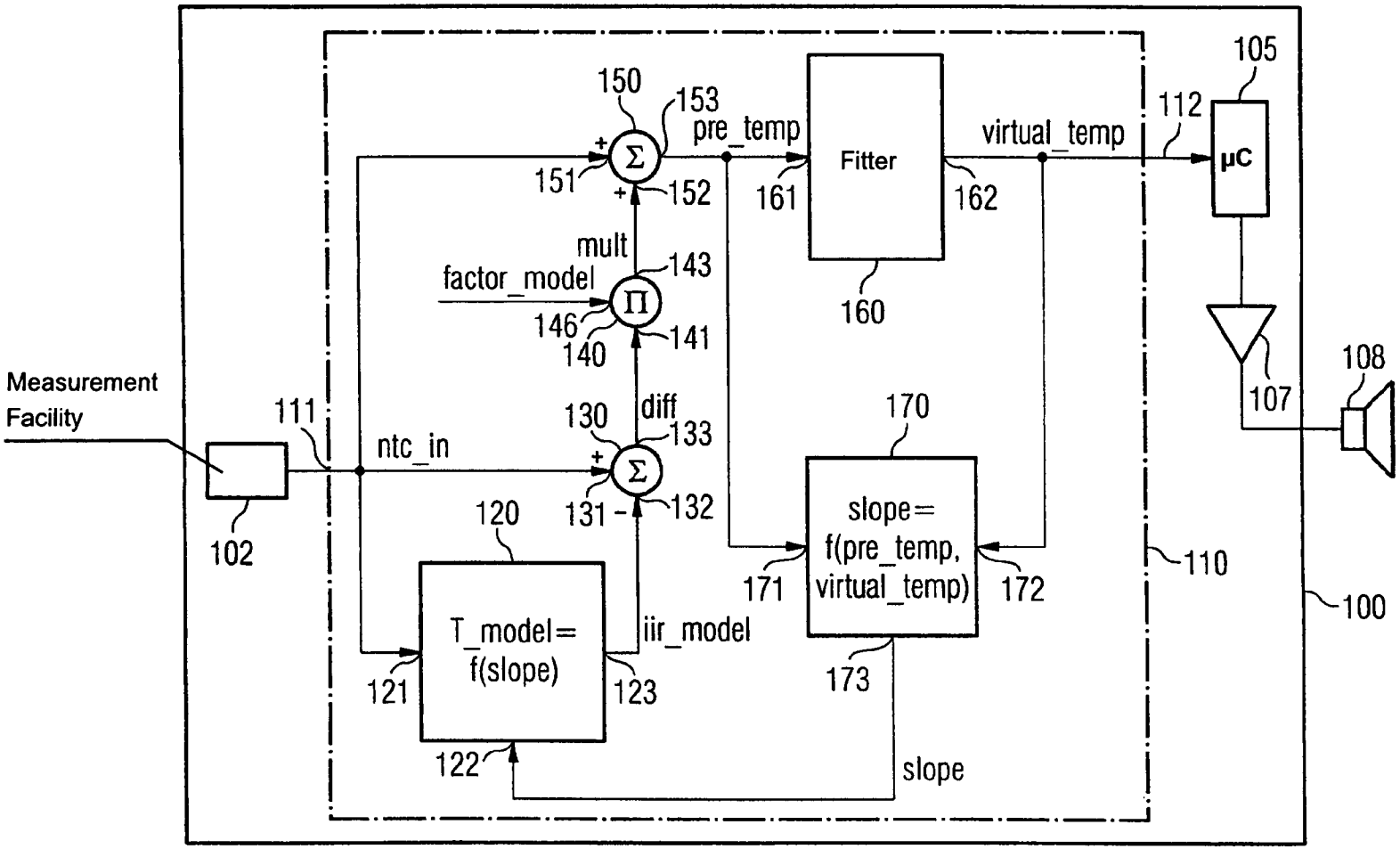
FIG. 1 is a block diagram of a thermal alarm indicator with a temperature measurement facility and an evaluation unit, representing an adaptive filter, for a temperature measurement signal of the temperature measurement facility.

Referring now to the figures of the drawing in detail and first, particularly, to FIG. 1 thereof, there is shown a thermal alarm indicator 100, which has a temperature sensor or temperature measurement facility 102 implemented in the form of an NTC (negative temperature coefficient) resistance. An output signal ntc_in of the temperature measurement facility 102 is fed to an evaluation device 110. The output signal ntc_in therefore represents the input signal for the evaluation device 110.

As will be explained in greater detail in the following, the evaluation device 110 is set up such that in the event of a hazard situation, a rise over time of the output signal ntc_in is optimized with a view to, on the one hand, the most rapid possible alarm triggering, and on the other hand, the prevention of artifacts that could result in false alarm indications.

Connected in series with the evaluation device 110 is a microprocessor 105, which checks the evaluation signal virtual temp provided by the evaluation device 110 with a view to its relevance to a hazard situation and where relevant initiates an alarm indication. According to the exemplary embodiment represented here, the alarm indication is effected acoustically via an amplifier 107 connected in series with the microprocessor 105 and a loudspeaker 108 connected to the amplifier 107.

Attention is drawn to the fact that the microprocessor 105 and the evaluation device 110 can also be realized by using a shared component, for example a microcontroller. The same applies to the microprocessor 105 and the amplifier 107.

The evaluation device 110 has an input 111 and an output 112. The output signal ntc_in of the temperature measurement facility 102 is fed to input 111. The evaluation signal virtual_temp is provided at the output 112.

According to the exemplary embodiment represented here, the evaluation device 110 furthermore has three components that are each connected to the input 111 via a suitable signaling line. As can be seen from FIG. 1, the input 111 of the evaluation device 110 is connected to a first input of a modeling unit 120. Alongside this, the input 111 is connected to the positive input 131 of a first summation unit 130 embodied as a subtraction unit, and to a first input 151 of a second summation unit 150.

A thermal model of the temperature measurement facility 102 is stored in the modeling unit 120. The thermal model also takes account of thermal masses or heat storage capacities that are coupled thermally to the temperature measurement facility 102. This applies particularly to a non-illustrated housing of the alarm indicator 100.

In this respect, the thermal masses result, in the known manner, in the situation that the temperature profile displayed by the temperature measurement facility 102 lags behind the true, really existing temperature profile. According to the exemplary embodiment represented here, this thermal inertia is described by a low-pass behavior. This low-pass behavior is determined by at least one characteristic time constant, which represents an important parameter of the thermal model.

In contrast to known evaluation methods for temperature measurement signals, the characteristic time constant does not necessarily have to be constant in the case of the evaluation device 100 described here. Rather, the characteristic time constant is dependent on a feedback signal slope (T_model=f (slope)). As will be explained again later in detail, the size of the feedback signal slope is dependent on the current gradient or the size of the change over time of the evaluation signal virtual temp according to the exemplary embodiment represented here.

As can furthermore be seen from FIG. 1, an output signal iir_model of the modeling unit 120 is fed via an output 123 of the modeling unit 120 to a negative input 132 of the subtraction unit 130. According to the exemplary embodiment represented here, the modeling unit 120 is a low-pass filter. The differential signal diff generated in the subtraction unit 130, between the input signal ntc_in and the output signal iir_model, is then fed via an output 133 of the subtraction unit 130 to an input 141 of a multiplication unit 140. In the multiplication unit 140, the differential signal diff is multiplied by a factor that is determined via a control input 146 of the multiplication unit 140 by using a control signal factor model. This multiplication factor can also be adjusted or corrected in a suitable manner at any time during the operation of the evaluation device 110.

The multiplied signal mult is fed via an output 143 of the multiplication unit 140 to a second input 152 of the second summation unit 150. In the second summation unit 150, the multiplied signal mult is then added to the input signal ntc_in fed via the first input 151 of the second summation unit 150. This generates a summation signal pre_temp, which represents the output signal of the second summation unit 150.

As can furthermore be seen from FIG. 1, the output signal pre_temp is fed via an output 153 of the second summation unit 153 to an input 161 of an output filter unit 160. According to the exemplary embodiment represented here, the output filter unit 160 represents a low-pass. In this respect, the low-pass can be a low-pass of any desired order. The low-pass converts the output signal pre_temp into a filtered evaluation signal virtual_temp, which is provided at an output 162 of the output filter unit 160. As already described above, the evaluation signal virtual_temp is fed via the output 112 of the evaluation device 110 to the microprocessor 105.

The following describes the feedback of the evaluation signal virtual_temp to the modeling unit 120, which makes the modeling unit 120 into the adaptive filter: according to the exemplary embodiment represented here, the feedback is effected via a gradient calculation unit 170. The gradient calculation unit 170 has (a) a first input 171, to which the output signal pre temp is fed, (b) a second input 172, to which the evaluation signal virtual temp is fed, and (c) an output 173. The feedback signal slope available at output 173, is fed to a second input 122 of the modeling unit 120. According to the exemplary embodiment represented here, the gradient, i.e. the size of the change over time of the output signal pre temp and/or of the evaluation signal virtual_temp is determined on the basis of the two signals pre_temp and virtual_temp in the gradient calculation unit 170. This relation can be described in general terms by the following equation:

$$\text{slope}=f(\text{pre_temp}, \text{virtual_temp}).$$

According to the exemplary embodiment represented here, the feedback signal slope determines the characteristic time constant of the model inversion.

In the case of the evaluation device 110 represented in FIG. 1, the characteristic time constant of the thermal model inversion is therefore varied in dependence on the steepness of the evaluation signal virtual temp. In the case of a particularly steep transient, this brings about a reduction of the time constant, which brings about an attenuation of the evaluation signal virtual temp as a result. The modeling unit 120 therefore represents an adaptive filter, which is varied in dependence on the output transient.

In this respect, the steepness of the evaluation signal virtual temp is measured as the difference between the signal at the input 161 and the signal at the output 162 of the linear output filter 160, which is embodied as a low-pass. In this respect, the low-pass of the output filter has a comparatively short time constant. The differential signal can be compared with a threshold value in the modeling unit 120. If the threshold value is exceeded, the time constant of the model is set to a shorter value. In this respect, a comparatively large time constant is selected, for example, if the feedback signal slope is small. If the feedback signal slope is comparatively large, then a smaller time constant is selected for the thermal model currently being used in the modeling unit 120. This dependency of the time constant being used on the feedback signal slope therefore represents an adaptive control mechanism in the case of the evaluation of the output signal ntc_in of the temperature measurement facility 102.

Figure 2:
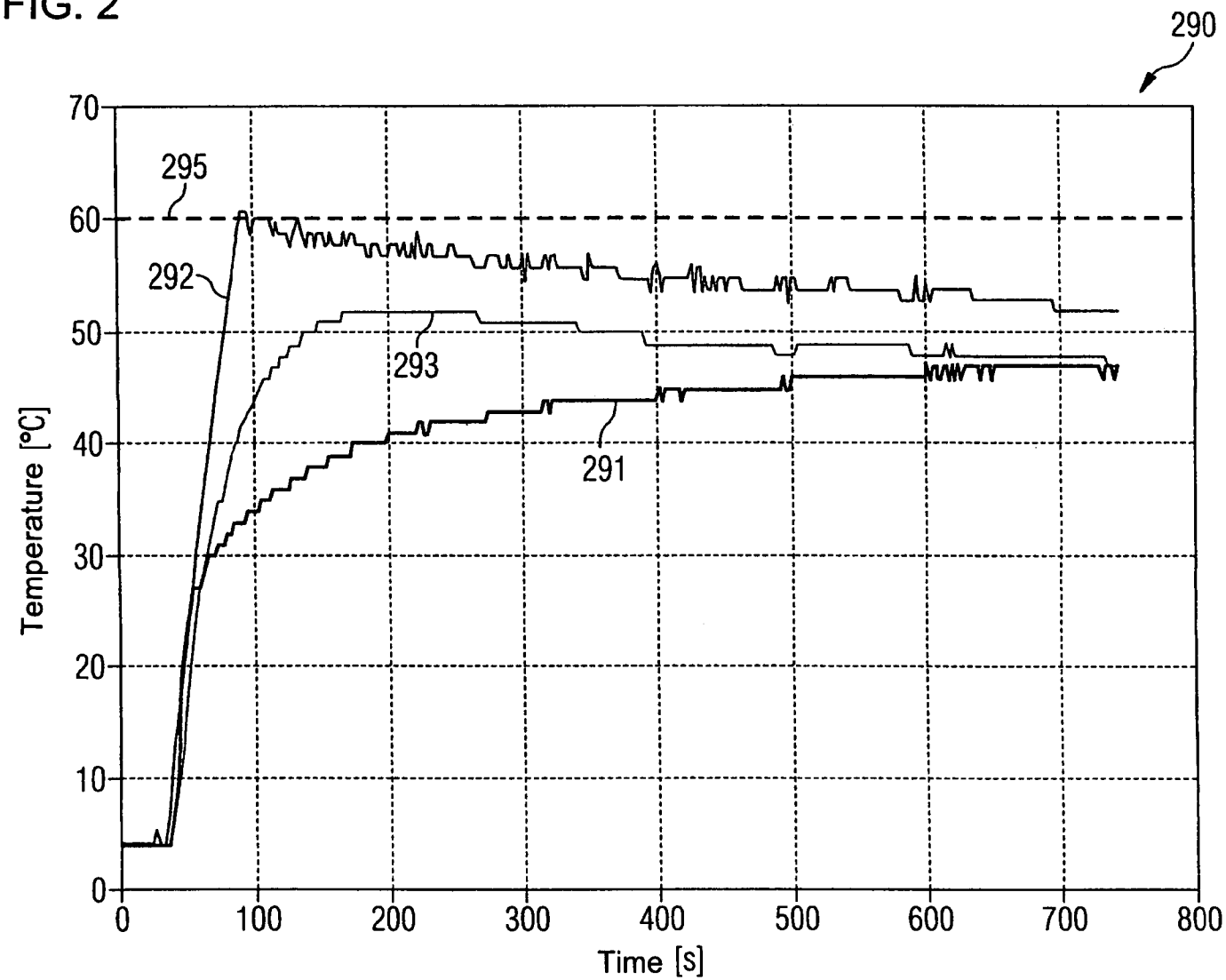
FIG. 2 is a graph showing, in a direct comparison, the behavior over time of a temperature evaluation based on an adaptive filter according to an exemplary embodiment of the invention and a known temperature evaluation making use an artificial rate-of-change limitation.

FIG. 2 plainly shows in a graph 290 the characteristic behavior of the evaluation device 110 described. In this respect, an abrupt temperature change from 5° Celsius to 50° Celsius in a monitored room is taken as the basis. The temperature measurement facility 102 therefore delivers a corresponding step response 291 as the input signal ntc_in. This is attenuated as a consequence of the thermal mass of the temperature measurement facility and shows the characteristic behavior of a low-pass of the second order.

The reference number 292 in FIG. 2 represents a standard implementation of a known evaluation device, which in fact has a more rapid rise compared with the step response and therefore would be suitable in principle for a rapid alarm triggering. To prevent an extremely strong overshoot, the standard implementation has an artificial rate-of-change limitation. However, in spite of this rate-of-change limitation, the evaluation signal 292 has an overshoot, which briefly rises above an alarm threshold 295 at approximately 90 s after the start of the abrupt temperature change and therefore triggers a false alarm.

Attention is drawn to the fact that overshoot could in fact be prevented or at least reduced by a stronger rate-of-change limitation. However, this would result in a markedly slower rise of the evaluation signal 292, so that genuine alarm indications could only be triggered with a marked delay. This would mean, therefore, that the American standard FM3210 could not be met.

The reference number 293 represents the behavior over time of the evaluation signal virtual temp of the evaluation device 110 represented in FIG. 1. It can be seen very well that the signal 293 rises steeply just like the evaluation signal 293. In the event of a thermally displayed hazard situation, therefore, a near-real-time alarm indication is likewise possible. Alongside this, an overshoot is prevented in an advantageous manner in the case of the signal 293 and the evaluation signal 293 is constantly spaced sufficiently far from the alarm limit 295. An undesirable false alarm can therefore be reliably prevented.

The described evaluation device 110 with the modeling unit 120, which represents an adaptive filter, has the now described advantages in particular.

First, the evaluation device 110 contributes in an advantageous manner to the stabilization of an inherently unstable computational model, which represents the inversion of a thermal model, which describes the thermal inertia of the temperature measurement facility and where relevant the thermal inertia of heat storage capacities coupled thermally to the temperature measurement facility. In terms of its behavior, the computational model is similar to a high-pass. The described temperature evaluation leads, in the presence of simultaneously rapid responding, to no or just very minor overshoots. In particular, the dynamics of the temperature evaluation are not restricted by known artificial steepness limitation facilities. Further advantages therefore arise even under "real" conditions, which are not tested in the relevant standards. For example, the alarm indicator becomes more robust even in the presence of strongly fluctuating temperatures or high wind speeds. Under these conditions, the parameters of a thermal system normally vary drastically. In the presence of high wind speeds, for example, the sensor can abruptly experience a different incident flow and react very much more rapidly as a result. A "rigid" system would have a number of problems here with the instabilities occurring.

Second, the feedback described or the adaptive filtering respectively results in that all standards relevant to thermal alarm indicators such as in particular the standards EN54-5 A1S and BS and the standard FM3210 can be met. This is notable to the extent that these standards, as already set forth above, actually contain contradictory requirements (FM3210 requires the most rapid possible alarm production, while EN54-5 "S" requires the prevention of false alarms).

Third, a further advantage of the evaluation device 110 described consists in the fact that the above standards can be met with the same algorithm. There is no need, therefore, for any complicated re-parameterization to be effected. This makes an alarm indicator fitted with the evaluation device 110 so good that all relevant standards can be met.

Fourth, the evaluation device 110 described can be realized by a simple piece of programming in the case of conventional thermal alarm indicators. Special hardware components are not required as a rule.

The invention claimed is:

1. A device for evaluating a temperature measurement signal of a temperature sensor, the device comprising:

a modeling unit having a first input for picking up an input signal being indicative of the temperature measurement signal, a second input for picking up a feedback signal, and an output for outputting an output signal, wherein the output signal is generated in dependence on the input signal and the feedback signal by using a computational model stored in said modeling unit, and wherein the feedback signal is one of directly and indirectly dependent on the output signal;

wherein the computational model has a thermal model for the temperature sensor.

2. The device according to claim 1, wherein the computational model has at least one model parameter having a value determined by the feedback signal.

3. The device according to claim 1, wherein the computational model represents an inversion of a thermal model of the temperature sensor.

4. The device according to claim 1, further comprising a gradient calculation unit having at least one input for one of directly and indirectly picking up the output signal of said modeling unit and an output for providing the feedback signal, wherein said gradient calculation unit is set up such that the feedback signal provided is indicative for a change over time of the output signal.

5. The device according to claim 4, wherein said at least one input of said gradient calculation unit includes a first input and a second input; and further comprising an output filter unit having an input for picking up the output signal of said modeling unit and an output for outputting an evaluation signal, wherein said input of said output filter unit is connected to said first input of said gradient calculation unit and said output of said output filter unit is connected to said second input of said gradient calculation unit.

6. The device according to claim 5, further comprising a first summation unit connected between said output of said modeling unit and said input of said output filter unit.

7. The device according to claim 6, further comprising a second summation unit and a multiplication unit, which are connected between said output of said first summation unit and said input of said output filter unit.

8. The device according to claim 1, wherein the device evaluates the temperature measurement signal being variable over time of the temperature sensor of an alarm indicator.

9. An alarm indicator for outputting an alarm indication in dependence on a captured temperature within a monitoring range, the alarm indicator comprising:

a temperature sensor for capturing the temperature within the monitoring range; and a device for evaluating a temperature measurement signal of said temperature sensor, said device including a modeling unit having a first input for picking up an input signal being indicative of the temperature measurement signal, a second input for picking up a feedback signal, and an output for outputting an output signal, wherein the output signal being generated in dependence on the input signal and the feedback signal by using a computational model stored in said modeling unit, and wherein the feedback signal is one of directly and indirectly dependent on the output signal;

wherein the computational model has a thermal model for the temperature sensor.

10. A method for evaluating a temperature measurement signal that is variable over time of a temperature sensor, the method which comprises the steps of:

picking up an input signal being indicative of the temperature measurement signal, by a first input of a modeling unit;

picking up a feedback signal by a second input of the modeling unit;

generating an output signal being dependent on the input signal and the feedback signal by using a computational model stored in the modeling unit, wherein the feedback signal is one of directly and indirectly dependent on the output signal, and wherein the computational model has a thermal model for the temperature sensor; and outputting the output signal at an output of the modeling unit.

11. The method according to claim 10, wherein the method evaluates the temperature measurement signal being variable over time of the temperature sensor of an alarm indicator.

12. A computer-readable storage medium having computer-executable instructions for evaluating a temperature measurement signal being variable over time of a temperature sensor, including evaluating the temperature measurement signal being variable over time of the temperature sensor of an alarm indicator, the computer-executable instructions performing the method steps of:

picking up an input signal being indicative for the temperature measurement signal, by a first input of a modeling unit;

picking up a feedback signal by a second input of the modeling unit;

generating an output signal being dependent on the input signal and the feedback signal by using a computational model stored in the modeling unit, wherein the feedback signal is one of directly and indirectly dependent on the output signal, and wherein the computational model has a thermal model for the temperature sensor; and outputting the output signal at an output of the modeling unit.

13. A program element for evaluating a temperature measurement signal being variable over time of a temperature measurement facility, including for evaluating a temperature measurement signal being variable over time of the temperature sensor of an alarm indicator, which, when the program element is executed by a processor, is set up for carrying out the steps of:

picking up an input signal being indicative of the temperature measurement signal, by a first input of a modeling unit;

picking up a feedback signal by a second input of the modeling unit;

generating an output signal being dependent on the input signal and the feedback signal by using a computational model stored in the modeling unit, wherein the feedback signal is one of directly and indirectly dependent on the output signal, and wherein the computational model has a thermal model for the temperature sensor; and outputting the output signal at an output of the modeling unit.

* * * * *